US008874449B2

(12) United States Patent
Lee

(10) Patent No.: US 8,874,449 B2
(45) Date of Patent: Oct. 28, 2014

(54) METHOD AND APPARATUS FOR DOWNMIXING MULTI-CHANNEL AUDIO SIGNALS

(75) Inventor: Chang-joon Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 423 days.

(21) Appl. No.: 13/272,632

(22) Filed: Oct. 13, 2011

(65) Prior Publication Data

US 2012/0093322 A1 Apr. 19, 2012

Related U.S. Application Data

(60) Provisional application No. 61/392,618, filed on Oct. 13, 2010.

(30) Foreign Application Priority Data

Feb. 15, 2011 (KR) ..... 10-2011-0013228

(51) Int. Cl.

| | |
|---|---|
| ***G10L 19/00*** | (2013.01) |
| ***G10L 19/008*** | (2013.01) |
| *G10L 19/02* | (2013.01) |
| *G10L 25/18* | (2013.01) |
| *G10L 19/022* | (2013.01) |

(52) U.S. Cl.

CPC ..... *G10L 19/008* (2013.01); *G10L 19/0212* (2013.01); *G10L 25/18* (2013.01); *G10L 19/022* (2013.01); *H04S 2400/03* (2013.01)

USPC ..... 704/500; 704/501; 704/502; 704/503; 704/E19.001

(58) Field of Classification Search

CPC ..... H04R 5/00; G10L 19/00

USPC ..... 381/17, 22–23; 704/500–501, E19.023

See application file for complete search history.

(56) References Cited

U.S. PATENT DOCUMENTS

| | | | | |
|---|---|---|---|---|
| 5,867,819 | A | 2/1999 | Fukuchi et al. | |
| 5,946,352 | A * | 8/1999 | Rowlands et al. | 375/242 |
| 6,141,645 | A * | 10/2000 | Chi-Min et al. | 704/500 |
| 6,205,430 | B1 * | 3/2001 | Hui | 704/500 |
| 6,356,870 | B1 * | 3/2002 | Hui et al. | 704/500 |
| 6,931,291 | B1 * | 8/2005 | Alvarez-Tinoco et al. | 700/94 |

(Continued)

FOREIGN PATENT DOCUMENTS

| | | | |
|---|---|---|---|
| CN | 1906664 | A | 1/2007 |
| CN | 101248483 | A | 8/2008 |

(Continued)

OTHER PUBLICATIONS

Communication dated Apr. 24, 2012 issued by the International Searching Authority in counterpart Korean International Application No. PCT/KR2011/007637.

(Continued)

*Primary Examiner* — Disler Paul

(74) *Attorney, Agent, or Firm* — Sughrue Mion, PLLC

(57) ABSTRACT

Downmixing multi-channel audio signals to target channels by pre-downmixing frequency coefficients that are encoded using a most frequently used block type in stereo channels in the frequency domain, thereby reducing an amount of calculations and an amount of power required to downmix the multi-channel audio signals.

20 Claims, 9 Drawing Sheets

(56) References Cited

U.S. PATENT DOCUMENTS

| | | | |
|---|---|---|---|
| 7,613,306 | B2 | 11/2009 | Miyasaka et al. |
| 8,160,888 | B2 | 4/2012 | Breebaart et al. |
| 8,583,424 | B2 | 11/2013 | Jaillet et al. |
| 2004/0070523 | A1 | 4/2004 | Craven et al. |
| 2009/0125314 | A1 | 5/2009 | Hellmuth et al. |
| 2009/0161795 | A1 | 6/2009 | Oh et al. |

FOREIGN PATENT DOCUMENTS

| | | | |
|---|---|---|---|
| CN | 102077276 | A | 5/2011 |
| EP | 0 990 368 | A1 | 4/2000 |
| EP | 1768107 | A1 | 3/2007 |

OTHER PUBLICATIONS

Communication dated May 28, 2014 issued by the State Intellectual Property Office of P.R. China in counterpart Chinese Patent Application No. 201180059881.9.

Communication dated Jul. 8, 2014 issued by the European Patent Office in counterpart European Patent Application No. 11832769.1.

* cited by examiner

METHOD AND APPARATUS FOR DOWNMIXING MULTI-CHANNEL AUDIO SIGNALS

CROSS-REFERENCE TO RELATED PATENT APPLICATION

This application claims the benefit of U.S. Provisional Application No. 61/392,618, filed on Oct. 13, 2010, in the U.S. patent and Trademark Office, and priority from Korean Patent Application No. 10-2011-0013228, filed on Feb. 15, 2011, in the Korean Intellectual Property Office, the disclosures of which are incorporated herein by reference in their entireties.

BACKGROUND

1. Field

Exemplary embodiments relate to a method and apparatus for downmixing multi-channel audio signals.

2. Description of the Related Art

Due to development of multimedia processing techniques, various audio channels are available. Compared to single-channel (mono) audio signals and 2-channel (stereo) audio signals, 5.1-channel audio signals and 7.1-channel audio signals are commonly used, and audio devices capable of outputting even more audio channels are being manufactured.

To perfectly output such multi-channel audio signals, audio devices supporting multi-channel audio signals are required. Therefore, mobile devices with limited available power, limited signal processing resources, and a limited number of output speakers are unable to properly output multi-channel audio signals. Therefore, mobile devices encode multi-channel audio signals into stereo-channel audio signals or mono-channel audio signals. The encoding is referred to as downmixing.

FIG. 1 is a block diagram for describing a common process for downmixing multi-channel audio signals.

As shown in FIG. 1, bitstreams of multi-channel audio signals are output to block 110 and unpacked therein. In block 120, unpacked data is inversely quantized and frequency coefficients are respectively restored with respect to multi-channels.

In block 130, each of the multi-channel frequency coefficients is converted into a signal in the time domain via an inverse transform. For example, in a case of downmixing a 5.1 channel bitstream to a stereo-channel bitstream, In the block 130, an inverse transform is performed on each of the 5 channel frequency coefficients in the block, and thus 5 frequency coefficients are generated. Generally, in a case of downmixing 5.1 channel audio signals, signals in a low frequency effects (LFE) channel are discarded. Here, the inverse transform is a process for converting signals in the frequency domain into signals in the time domain, where an inverse fast Fourier transform (IFFT) is generally employed.

In block 140, levels of audio signals in the time domain converted from the multi-channel frequency coefficients are suitably adjusted for channels, and the adjusted multi-channel audio signals are downmixed to stereo-channel audio signals. Generally, levels of 5.1 channel audio signals are adjusted while the 5.1 channel audio signals are being downmixed to stereo-channel audio signals.

$$Lo=L+0.707C+0.707Ls$$

$$Ro=R+0.707C+0.707Rs$$

(Lo, Ro: Stereo Left/Right, L: left, R: Right, Ls: Left Surround, Rs: Right Surround, C: Center)

In block 150, post-processing required by an audio codec (e.g., overlap and add process) is performed and final stereo-channel audio signals are output.

In such a common downmixing method, the number of channels in source audio signals may be reduced, and thus multi-channel audio signals may be converted into stereo-channel audio signals suitable for mobile devices. However, such a downmixing process requires a large amount of power and resources. Particularly, the inverse transform process involves a large amount of calculations. Here, since the power and resources consumed increase as the number of channels of audio signal source increases, a method of downmixing multi-channel audio signals requiring relatively fewer calculations and less power is necessary for devices with limited performances, such as mobile devices.

SUMMARY

Aspects of the exemplary embodiments provide a method and apparatus for downmixing multi-channel audio signals by using less power and requiring fewer calculations.

According to an aspect of the exemplary embodiments, there is provided a method of downmixing multi-channel audio signals to target channels, the method including determining a type of block employed for encoding a corresponding audio sample with respect to each of a plurality of multi-channel frequency coefficients; downmixing frequency coefficients to which a type of block that is most frequently used with respect to each of the target channels is applied based on a result of the determining; converting frequency coefficients generated as a result of the downmixing and frequency coefficients that are not downmixed into signals in the time domain; and generating signals of the target channels using the signals in the time domain.

The step of generating signals of the target channels includes adjusting levels of signals generated from the frequency coefficients that are not downmixed; and downmixing the adjusted signals and signals generated from the converted frequency coefficients as a result of the downmixing.

The step of downmixing includes, if the downmixing method is a Stereo Left/Right method and a plurality of types of blocks have been used a same number of times, a frequency coefficient to be reflected to stereo channels, determined from among the multi-channel frequency coefficients and a type of block that is not used with respect to the frequency coefficient, is determined as the type of block that is most frequently used.

According to another aspect of the exemplary embodiments, there is provided a downmixing apparatus for downmixing multi-channel audio signals to target channels, the downmixing apparatus including a block type determining unit that determines a type of block employed for encoding a corresponding audio sample with respect to each of multi-channel frequency coefficients; a downmixing unit that downmixes frequency coefficients to which a type of block that is most frequently used with respect to each of the target channels is applied based on a result of the block type determining unit; a converting unit that converts frequency coefficients generated as a result of the downmixing and frequency coefficients that are not downmixed into signals in the time domain; and a target channel signal generating unit that generates signals of the target channels by using the signals in the time domain.

The target channel signal generating unit includes a level adjusting unit that adjusts levels of signals generated from the frequency coefficients that are not downmixed; and a downmixing unit that downmixes the adjusted signals and signals generated from converted frequency coefficients as a result of the downmixing.

If the downmixing unit performs a Stereo Left/Right downmixing method and a plurality of types of blocks have been used a same number of times, the downmixing unit determines a frequency coefficient to be reflected to stereo channels from among the multi-channel frequency coefficients and determines a type of block that is not used with respect to the frequency coefficient as the type of block that is most frequently used.

According to another aspect of the exemplary embodiments, there is provided a computer-readable recording medium having recorded thereon a computer program for implementing the method of downmixing multi-channel audio signals to target channels.

BRIEF DESCRIPTION OF THE DRAWINGS

The above and other aspects will become more apparent by describing in detail exemplary embodiments thereof with reference to the attached drawings in which.

DETAILED DESCRIPTION OF THE EXEMPLARY EMBODIMENTS

Hereinafter, the exemplary embodiments will be described in detail with reference to the attached drawings.

Although it is assumed in the exemplary embodiments described below that multi-channel audio signals are downmixed to stereo-channel (2 channel) audio signals, the exemplary embodiments are not limited to cases in which the target channel for mixing-down audio signals is a stereo-channel.

Figure 1:
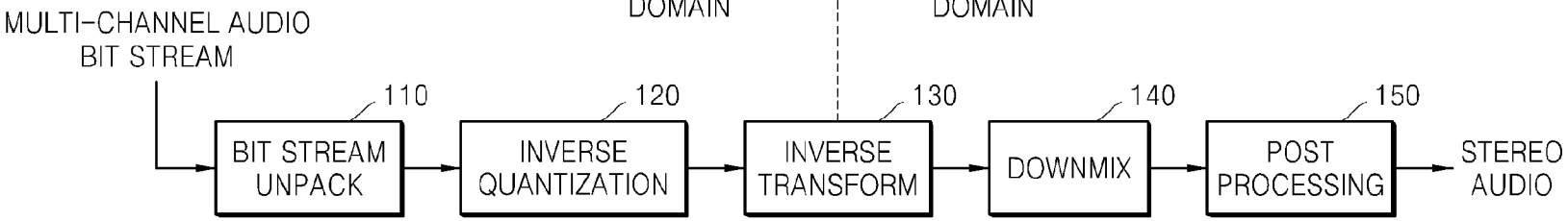
FIG. 1 (RELATED ART)
FIG. 1 is a block diagram for describing a common process for downmixing multi-channel audio signals.
Figure 2:
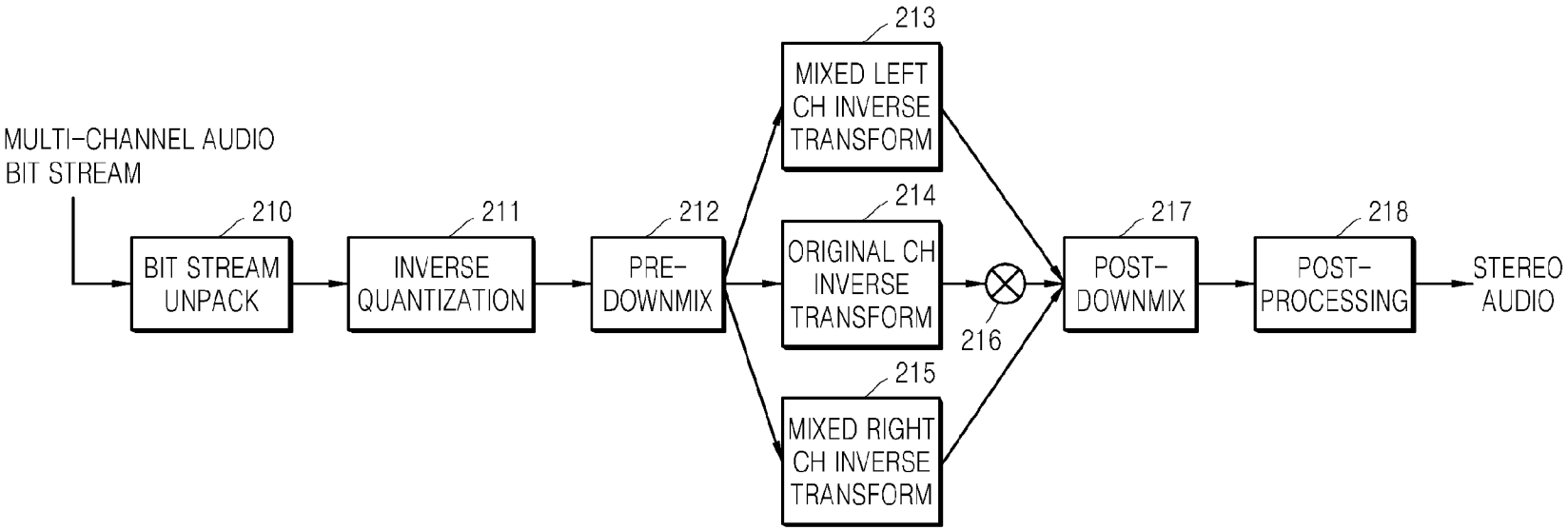
FIG. 2 is a block diagram for describing downmixing of multi-channel audio signals according to an exemplary embodiment.

FIG. 2 is a block diagram for describing downmixing of multi-channel audio signals according to an exemplary embodiment.

As shown in FIG. 2, bitstreams of multi-channel audio signals are input to a block 210 and unpacked. In a block 211, the unpacked data is inversely quantized and frequency coefficients are respectively restored with respect to multi-channels.

In a block 212, levels of the multi-channel frequency coefficients are suitably adjusted by respectively multiplying the multi-channel frequency coefficients by predetermined values and are downmixed in the frequency domain. The inputs of the block 212, that is, the multi-channel frequency coefficients restored in the block 211, are generated by encoding blocks of pulse coding modulation (PCM) audio samples of source multi-channel audio signals using an encoder. Generally, the types of blocks applied to encoding may be categorized into two types according to the lengths of audio sample blocks used in the encoding: long and short. In the block 212, the multi-channel frequency coefficients may be downmixed only with respect to channels to which the same type of blocks have been applied during an encoding process.

In the block 212, a type of blocks that is most frequently used by the multi-channel frequency coefficients (referred to hereinafter as a 'major type') is determined with respect to each of the stereo-channels, and levels of the frequency coefficients, to which the major-type blocks are applied, are suitably adjusted and downmixed. The pre-downmixing in the frequency domain is performed with respect to each of the stereo-channels, and frequency coefficients to which the major type blocks are not applied are not downmixed in the frequency domain.

In a block 213, a result of downmixing with respect to the Stereo Left channel is inversely transformed. In a block 214, frequency coefficient(s), which are not downmixed with respect to stereo-channels, are inversely transformed. In a block 215, a result of downmixing with respect to the Stereo Right channel is inversely transformed.

In a block 216, levels of the frequency coefficient(s) that are not downmixed with respect to stereo-channels are suitably adjusted. As described above, levels of the frequency coefficients that are pre-downmixed in the frequency domain are suitably adjusted before the frequency coefficients are downmixed in the block 212, and thus, it is not necessary to adjust levels of audio signals of the corresponding channels again in the time domain.

In a block 217, audio signals generated as a result of the inverse transform are downmixed for each stereo channel in the time domain.

In a block 218, a post-processing required by an audio codec (e.g., overlap and add process) is performed and final stereo-channel audio signals are output.

As described above, according to an exemplary embodiment, from among multi-channel frequency coefficients, some frequency coefficients that are encoded by using the major type blocks in each of the stereo channels are pre-downmixed in the frequency domain. Therefore, according to an exemplary embodiment, the number of inverse transforms is reduced as compared to a conventional process in which an inverse transform is performed with respect to each of the multi-channel frequency coefficients, and thus the amount of calculations and power required for downmixing multi-channel audio signals may be reduced.

Figure 3:
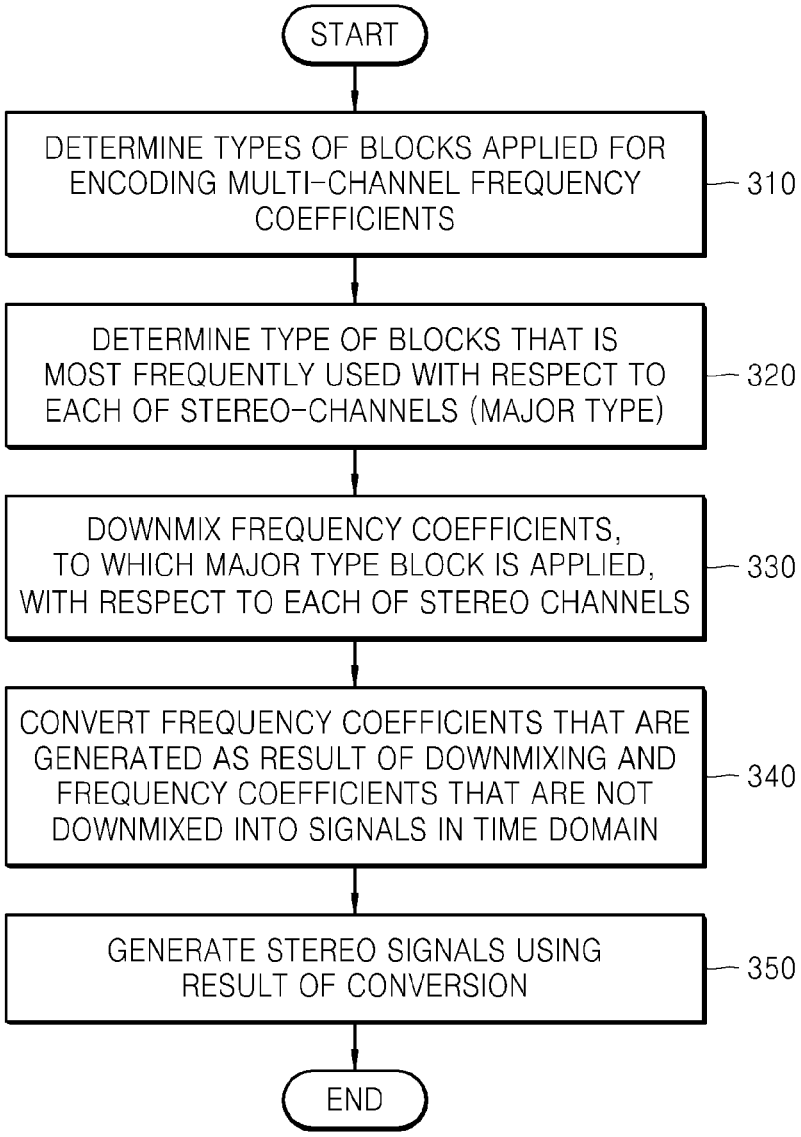
FIG. 3 is a flowchart for describing a method of downmixing multi-channel audio signals, according to an exemplary embodiment.

FIG. 3 is a flowchart for describing a method of downmixing multi-channel audio signals, according to an exemplary embodiment.

In operation 310, the types of blocks respectively applied for encoding multi-channel frequency coefficients are determined. Generally, the types of blocks are categorized into two types: long and short.

In operation 320, a type of blocks that is most frequently used by the stereo-channel frequency coefficients (referred to hereinafter as a 'major type') is determined with respect to each of the stereo-channels. For example, if frequency coefficients of channels C, R, and Rs to be reflected to the Stereo Right channel are respectively encoded by using a long type block, a short type block, and a short type block, the major type block in the Stereo Right channel is a short type block.

Methods of downmixing multi-channels to stereo channels are categorized into a left/right total method and a left/right only method. In the left/right total method, an RS component is reflected to Stereo Left channel sounds, whereas a LS component is reflected to Stereo Right channel sounds. Generally, in a case of downmixing 5.1 channels to stereo channels by using the left/right total method, the equations below are employed.

$$Lt=L+0.707C-0.707(Ls+Rs)$$

$$Rt=R+0.707C+0.707(Ls+Rs)$$

(Lt, Rt: Stereo Left/Right, L: left, R: Right, Ls: Left Surround, Rs: Right Surround, C: Center)

On the contrary, in the left/right only method, from among multi-channel sounds components, multi-channel sound components corresponding to the left or right side of a user's location are not reflected to the opposite side channel. Generally, in a case of downmixing 5.1 channels to stereo channels by using the left/right only method, the equations below are employed.

$$Lo=L+0.707C+0.707Ls$$

$$Ro=R+0.707C+0.707Rs$$

(Lo, Ro: Stereo Left/Right, L: left, R: Right, Ls: Left Surround, Rs: Right Surround, C: Center)

While a major type block is being determined with respect to each of the stereo channels in operation 320, there may be a case in which two types of blocks are used for the same number of times. In this case, in the left/right only method, a type of block that is not used with respect to a frequency coefficient of a common channel (a channel that is reflected to both stereo channels) from among multi-channel frequency coefficient may be determined as the major type block. For example, if a common channel in source multi-channel audio signals is center C and a long type block applied to the center C, a short type block may be determined as the major type block. After a frequency coefficient of a common channel is inversely transformed once, the level of the frequency coefficient is suitably adjusted in both stereo channels and is downmixed in the time domain. As a result, the number of inverse transforms may be reduced as compared to a case of downmixing a frequency coefficient of a common channel in the frequency domain. A detailed description thereof will be provided below with reference to FIG. 7.

In operation 330, frequency coefficients to which the major type block is applied are downmixed with respect to each of the stereo channels. Here, levels of the frequency coefficients for each of the stereo channels are suitably adjusted before being downmixed.

For example, if frequency coefficients of channels C, R, and Rs to be reflected to the Stereo Right channel are generated by respectively encoding audio samples by a long type block, a short type block, and a short type block, only frequency coefficients of the channels R and Rs to which the major type block is applied are downmixed. For example, the level of the frequency coefficients of the channel Rs is adjusted by multiplying the coefficient of the channel Rs by 0.707 according to the equation Ro=R+0.707C+0.707Rs, and the Rs component and R component with adjusted levels are downmixed in the frequency domain.

In operation 340, frequency coefficients that are generated as a result of downmixing and frequency coefficients that are not downmixed are converted into signals in the time domain via inverse transforms. Some (components to which the major type block is applied) of the multi-channel frequency coefficients are pre-downmixed in the frequency domain, and thus the number of inverse transforms in operation 340 is less than the number of channels of the multi-channel.

In operation 350, stereo signals are generated using the signals in the time domain. A detailed description of operation 350 will be provided below with reference to FIG. 4.

Figure 4:
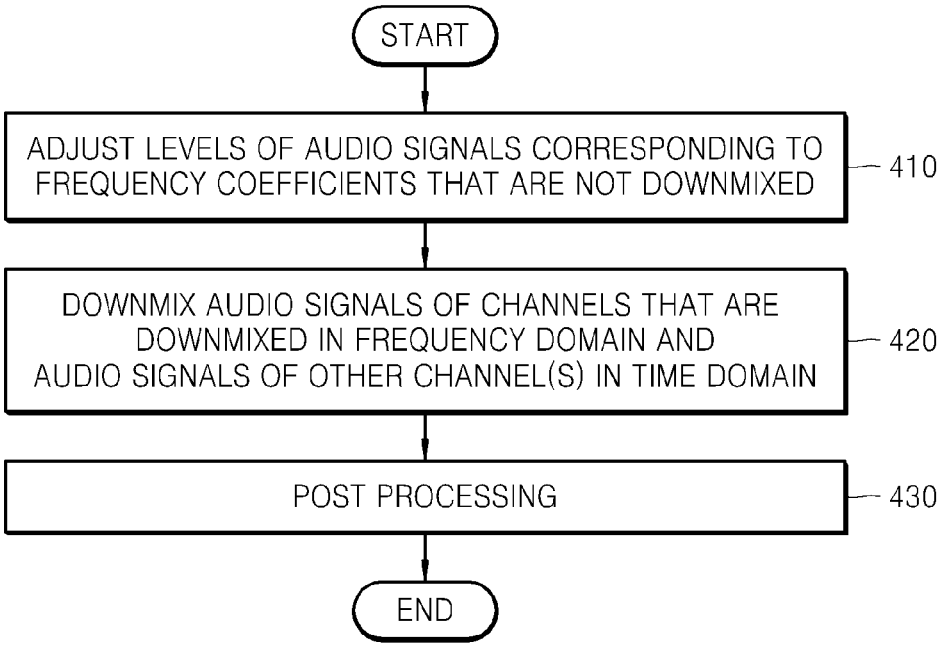
FIG. 4 is a flowchart for describing generation of stereo signals, according to an exemplary embodiment.

FIG. 4 is a flowchart for describing generation of stereo signals, according to an exemplary embodiment.

In operation 410, levels of audio signals corresponding to frequency coefficients that are not downmixed are adjusted. The audio signals corresponding to frequency coefficients that are not downmixed refer to signals in the time domain that are acquired by inversely transforming the frequency coefficients that are not downmixed.

In operation 420, the audio signals of channels that are downmixed in the frequency domain and audio signals of other channel(s) are downmixed in the time domain.

In operation 430, signals of each of the stereo channels are post-processed and final stereo signals are output.

Figure 5:
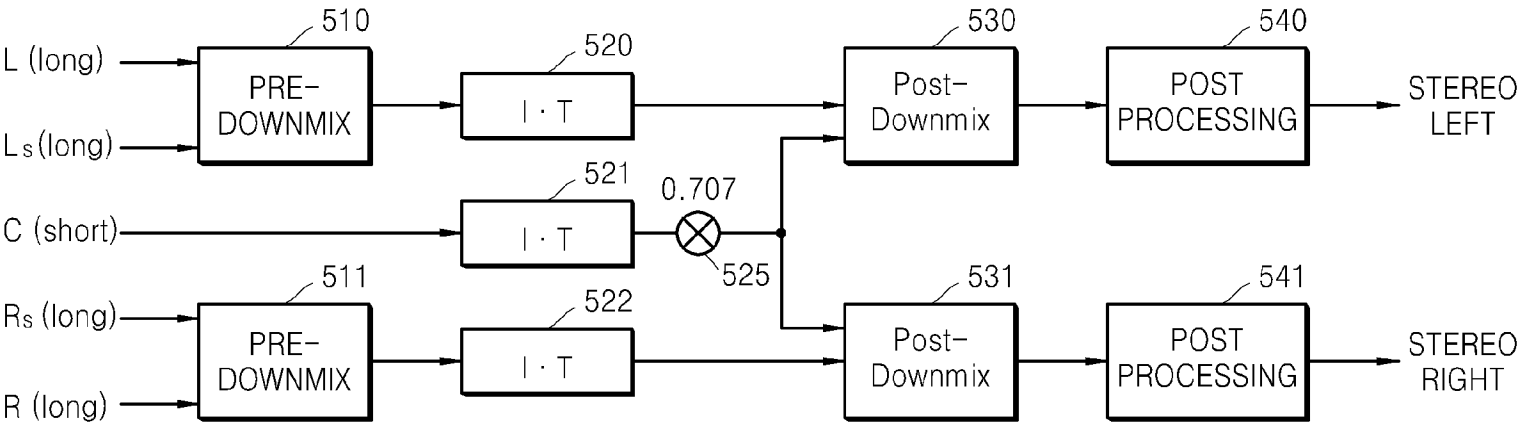
FIG. 5 is a block diagram showing a method of downmixing 5.1 channel audio signals using a left-right only method, according to an exemplary embodiment.

FIG. 5 is a block diagram showing a method of downmixing 5.1 channel audio signals using a left-right only method, according to an exemplary embodiment.

As shown in FIG. 5, it is assumed that audio samples of 5.1 channels L, Ls, C, Rs, and R except a channel LFE are respectively encoded by using a long type block, a long type block, a short type block, a long type block, and a long type block and are downmixed according to the equations below.

$$Lo=L+0.707C+0.707Ls \quad (1)$$

$$Ro=R+0.707C+0.707Rs \quad (2)$$

(Lo, Ro: Stereo Left/Right, L: left, R: Right, Ls: Left Surround, Rs: Right Surround, C: Center)

First, in the channels L, Ls, and C to be reflected to the channel Lo, the major type block is a long type block. Therefore, frequency coefficients of the channels L and Ls are downmixed in a block 510. Although not shown, the level of the frequency coefficient of the channel Ls is adjusted by multiplying the coefficient of the channel Ls by 0.707 according to the equations above. Hereinafter, even though not described, it is assumed that level adjustment as described above is performed in blocks for downmixing in the frequency domain.

A frequency coefficient generated as a result of the downmixing is inversely transformed in a block 520 and is converted into a signal in the time domain.

Next, in the channels R, Rs, and C to be reflected to the channel Ro, the major type block is also a long type block. Therefore, frequency coefficients of the channels R and Rs are downmixed in a block 511. Although not shown, the level of the frequency coefficient of the channel Rs is adjusted by multiplying the coefficient of the channel Rs by 0.707 according to the equations above. Frequency coefficient generated as a result of the downmixing is inversely transformed in a block 522 and is converted into signals in the time domain.

On the contrary, a type of block that is not the major type of block (referred to hereinafter as a minor type) in both Lo/Ro is a short type block. Therefore, in a case of the center C channel to which short type block is applied for encoding, a corresponding frequency coefficient is inversely transformed in the block 521 without being downmixed.

In a block 525, levels of output signals of the block 521, that is, signals in the time domain of the center C component, are adjusted by multiplying the coefficient of the center channel C by 0.707 according to Equations 1 and 2. A coefficient used for level adjustment is the same in both the frequency domain and the time domain due to the linearity of inverse transform.

In a block 530, multi-channel components constituting the channel Lo, that is, the output signal of the block 520 and the output signal of the block 525, are downmixed (downmixing in the time domain). In a block 540, output signal of the block 530 are post-processed, and thus Stereo Left signal is output.

In a block 531, multi-channel components constituting the channel Ro, that is, the output signal of the block 522 and the output signal of the block 525, are downmixed (downmixing in the time domain). In a block 541, output signal of the block 531 is post-processed, and thus Stereo Right signal is output.

In a case of the embodiment shown in FIG. 5, although it is necessary to perform inverse transform five times in a conventional process, inverse transforms are only performed three times in the exemplary embodiment, and thus the amount of calculations and consumed power may be reduced.

Figure 6:
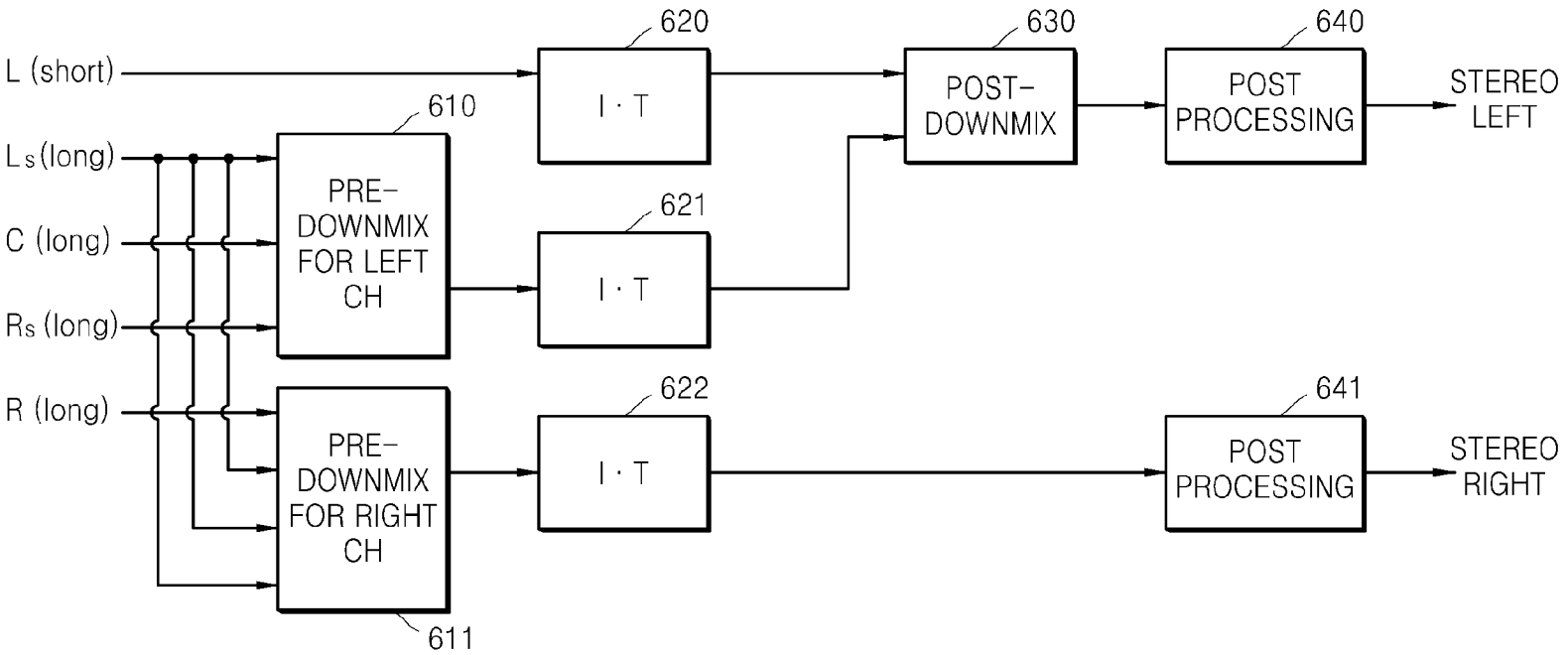
FIG. 6 is a block diagram showing a method of downmixing 5.1 channel audio signals using a left-right total method, according to an exemplary embodiment.

FIG. 6 is a block diagram showing a method of downmixing 5.1 channel audio signals using a left-right total method, according to an exemplary embodiment.

As shown in FIG. 6, it is assumed that audio samples of 5.1 channels L, Ls, C, Rs, and R except a channel LFE are respectively encoded by using a short type block, a long type block, a long type block, a long type block, and a long type block and are downmixed according to the equations below.

$$Lt=L+0.707C-0.707(Ls+Rs) \quad (3)$$

$$Rt=R+0.707C+0.707(Ls+Rs) \quad (4)$$

(Lt, Rt: Stereo Left/Right, L: left, R: Right, Ls: Left Surround, Rs: Right Surround, C: Center)

First, in the channels L, Ls, C, and Rs to be reflected to the channel Lt, the major type block is a long type block. Therefore, the frequency coefficients of the channels L, C, and Rs are downmixed in a block 610. Although not shown, the levels of the frequency coefficients of the channel C, Ls, and Rs are adjusted according to Equation 3 above. Frequency coefficient generated as a result of the downmixing is inversely transformed in a block 621 and is converted into a signal in the time domain. The channel L to which the minor type block is applied in the channel Lt is inversely transformed in a block 620 without being downmixed in the frequency domain.

In a block 630, output signals of the blocks 620 and 621 are downmixed in the time domain.

In a block 640, output signal of the block 630 is post-processed, and thus final Stereo Left signal is output.

In the channels R, Rs, C, and Ls to be reflected to the channel Rt, the major type block is also a long type block. Therefore, frequency coefficients of the channels R, Rs, C, and Ls are downmixed after levels of the frequency coefficients of the channels R, Rs, C, and Ls are adjusted in a block 611 according to the Equation 4. Frequency coefficient generated as a result of the downmixing in the block 611 is inversely transformed in a block 622 and is converted into a signal in the time domain.

In a block 641, output signal of the block 622 is post-processed, and thus stereo right signal is output.

Figure 7:
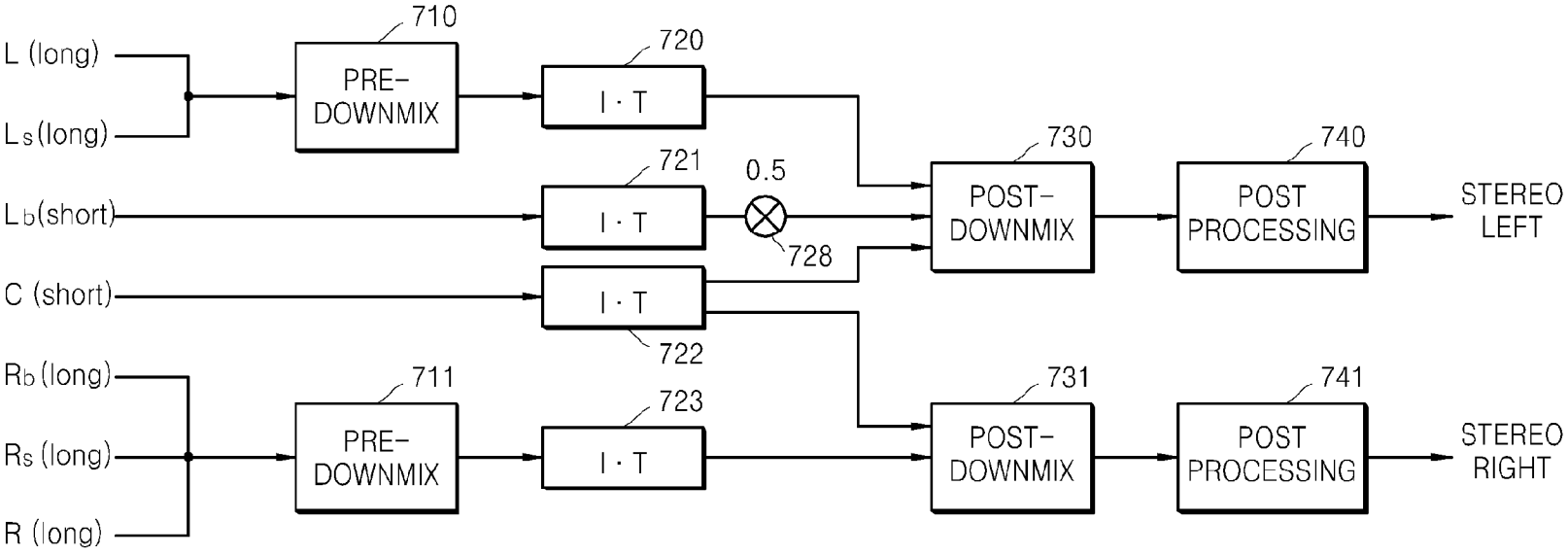
FIG. 7 is a block diagram showing a method of downmixing 7.1 channel audio signals using a left-right only method, according to an exemplary embodiment.

FIG. 7 is a block diagram showing a method of downmixing 7.1 channel audio signals using a left-right only method, according to an exemplary embodiment.

As shown in FIG. 7, it is assumed that PCM audio samples of 7.1 channels L, Ls, Lb, C, Rb, Rs, and R except a channel LFE are respectively encoded by using a long type block, a long type block, a short type block, a short type block, a long type block, a long type block, and a long type block and are downmixed according to the equations below.

$$Lo=L+0.707C+0.707Ls+0.5Lb \quad (5)$$

$$Ro=R+0.707C+0.707Rs+0.5Rb \quad (6)$$

(Lo, Ro: Stereo Left/Right, L: left, R: Right, Ls: Left Surround, Rs: Right Surround, Lb: Left Back, Rb: Right Back, C: Center)

First, it is necessary to determine the major type block in the channel Lo. Regarding channels L, Ls, Lb, and C to be reflected to the channel Lo, a long type block and a short type block are both applied twice. In this case, a common channel to be reflected to both channels Lo and Ro is determined from among multi channels and a type of block not applied to the common channel is determined as the major type block.

In the present exemplary embodiment, the center channel C is the common channel to be reflected to both channels Lo and Ro. Since a frequency coefficient of the channel C is encoded by using a short type block, a long type block is determined as the major type block of the channel Lo. The reason of determining a type of block not applied to the common channel as the major type block is to reduce the number of inverse transforms. In other words, if a long type block is determined as the major type block, it is necessary to perform inverse transforms four times. However, if a short type block is determined as the major type block, it is necessary to perform inverse transforms five times.

Frequency coefficients of the channels L and Ls to which the major type block is applied are downmixed in a block 710 and are converted into signals in the time domain in a block 720.

Frequency coefficients of the channels Lb and C to which the minor type block is applied are not downmixed and are converted into to signals in the time domain in blocks 721 and 722, respectively. The level of the component of the channel Lb is adjusted by being multiplied by 0.5 in a block 728 according to Equation 5.

In a block 730, multi-channel components to be reflected to the channel Lo are downmixed in the time domain. A result of the downmixing is post-processed in a block 740, and thus Stereo Left (Lo) signal is generated.

Next, the major type block in the channel Ro is a long type block. Therefore, frequency coefficients of the channels R, Rs, and R are downmixed in a block 711 and are inversely transformed in a block 723.

In a block 731, multi-channel components constituting the channel Ro are downmixed in the time domain. A result of the downmixing is post-processed in a block 741, and thus Stereo Right (Ro) signal is generated.

Figure 8:
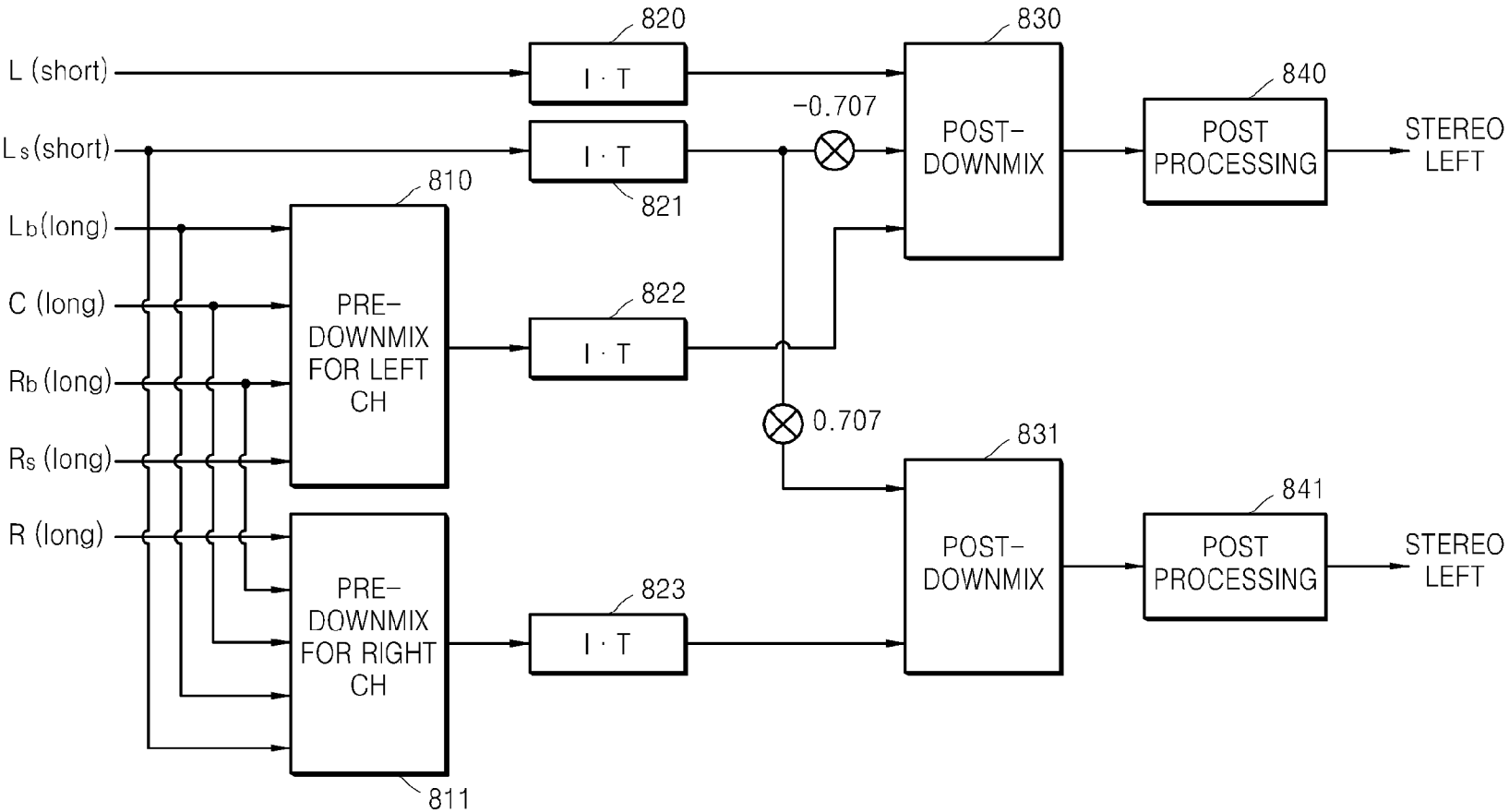
FIG. 8 is a block diagram showing a method of downmixing 7.1 channel audio signals using a left-right total method, according to an exemplary embodiment.

FIG. 8 is a block diagram showing a method of downmixing 7.1 channel audio signals using a left-right total method, according to an exemplary embodiment.

As shown in FIG. 8, it is assumed that PCM audio samples of 7.1 channels L, Ls, Lb, C, Rb, Rs, and R except a channel LFE are respectively encoded by using a short type block, a short type block, a long type block, a long type block, a long type block, a long type block, and a long type block and are downmixed according to the equations below.

$$Lt=L+0.707C-0.707(Ls+Rs)-0.5(Lb+Rb) \quad (7)$$

$$Rt=R+0.707C+0.707(Ls+Rs)+0.5(Lb+Rb) \quad (8)$$

(Lt, Rt: Stereo Left/Right, L: left, R: Right, Ls: Left Surround, Rs: Right Surround, Lb: Left Back, Rb: Right Back, C: Center)

In this case, the major type block in both the channels Lt and Rt is a long type block. The channels L and Ls to which the minor type block is applied are not downmixed in the frequency domain and are inversely transformed in blocks 820 and 821, respectively. From among multi-channel components constituting the channel Lt, frequency coefficients of channels Lb, C, Rb, and Rs to which the major type block is applied are downmixed in a block 810. Frequency coefficients generated as a result of the downmixing are inversely transformed in a block 822.

In a block 830, multi-channel components constituting the channel Lt are downmixed in the time domain. As shown in FIG. 8, the component of the channel Ls is downmixed after the level of the component of the channel Ls is adjusted according to Equation 7.

Signal output by the block 830 is post-processed in a block 840, and thus Stereo Left signal Lt is output.

Next, from among multi-channel components constituting the channel Rt, frequency coefficients of channels R, Rs, Rb, C, and Lb to which the major type block is applied are downmixed in a block 811. Frequency coefficients generated as a result of the downmixing are inversely transformed in a block 823.

In a block 831, the multi-channel components constituting the channel Rt are downmixed in the time domain. As shown in FIG. 8, the component of the channel Ls is downmixed after the level of the component of the channel Ls is adjusted according to Equation 8.

Signal output by the block 831 is post-processed in a block 841, and thus Stereo Right signal Rt is output.

Figure 9:
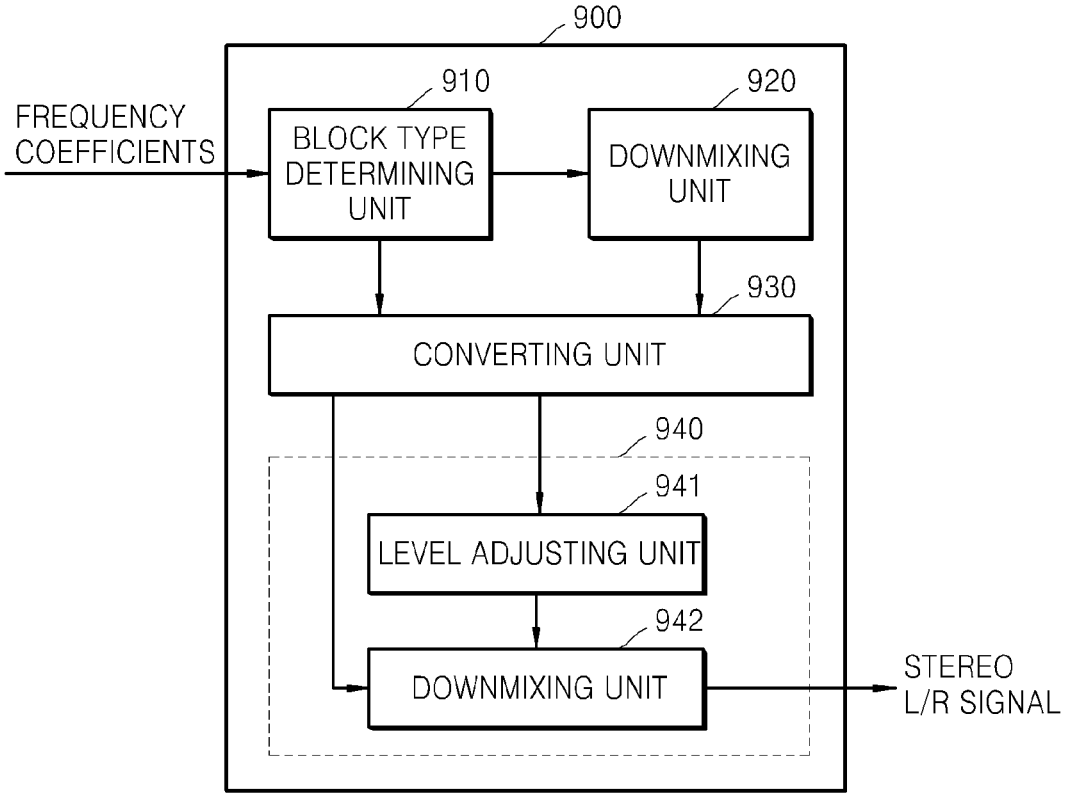
FIG. 9 is a diagram showing the structure of a down-mixing apparatus according to an exemplary embodiment.

FIG. 9 is a diagram showing the structure of a down-mixing apparatus 900 according to an exemplary embodiment.

As shown in FIG. 9, the down-mixing apparatus 900 includes a block type determining unit 910, a downmixing unit 920, a converting unit 930, and a stereo signal generating unit 940.

The block type determining unit 910 determines a type of block used for encoding audio sample data in a corresponding channel with respect to each of the multi-channel frequency coefficients. For example, if the target channel is stereo channels, the block type determining unit 910 determines a type of block used for encoding audio sample data to generate multi-channel components to be reflected to each of the Stereo Left/Right channels.

Based on a determination result of the block type determining unit 910, the downmixing unit 920 downmixes frequency coefficients of channels corresponding to a type of block that is most frequently used with respect to each of the target channels, that is, the major type block. Here, the frequency coefficients are downmixed in the frequency domain, and, as described above, levels of the multi-channel frequency coefficients are adjusted according to a predetermined equation, such as any one of the Equations 1 through 6, before the frequency coefficients are downmixed.

If the stereo left/right only method is employed as a downmixing method and a plurality of types of blocks are used for the same number of times, a type of block not used with respect to a frequency coefficient of a common channel that is to be reflected to both of the stereo channels may be determined as the major type block.

The converting unit 930 converts frequency coefficients output by the downmixing unit 920 to signals in the time domain via inverse transforms. An inverse transform may be performed as an IFFT, for example. However, a conversion function is not limited to thereto.

The stereo signal generating unit 940 generates signals of the final target channel by using signals in the time domain that are output by the converting unit 930. The stereo signal generating unit 940 includes a level adjusting unit 941 and a downmixing unit 942.

The level adjusting unit 941 adjusts levels of signals of channels, which are not downmixed at the downmixing unit 920, in the time domain according to a predetermined equation, such as any one of Equations 1 through 6.

The downmixing unit 942 outputs signals of the final target channels by downmixing the signals of which levels are adjusted by the level adjusting unit 941 and the signals downmixed in the frequency domain.

The exemplary embodiments be embodied as computer readable codes on a computer readable recording medium. The computer readable recording medium is any data storage device that can store data which can be thereafter read by a computer system.

Examples of the computer readable recording medium include read-only memory (ROM), random-access memory (RAM), CD-ROMs, magnetic tapes, floppy disks, optical data storage devices, etc.

The exemplary embodiments may embodied by an apparatus, for example a mobile device, that includes a bus coupled to every unit of the apparatus, at least one processor (e.g., central processing unit, microprocessor, etc.) that is connected to the bus for controlling the operations of the apparatuses to implement the above-described functions and executing commands, and a memory connected to the bus to store the commands, received messages, and generated messages.

As will be understood by the skilled artisan, the exemplary embodiments may be implemented as software or hardware components, such as a Field Programmable Gate Array (FPGA) or Application Specific Integrated Circuit (ASIC), which performs certain tasks. A unit or module may advantageously be configured to reside on the addressable storage medium and configured to execute on one or more processors or microprocessors. Thus, a unit or module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or modules or further separated into additional components and units or modules.

While the exemplary embodiments have been particularly shown and described, it will be understood by those of ordinary skill in the art that various changes in form and details may be made therein without departing from the spirit and scope of the present invention as defined by the following claims.

What is claimed is:

1. A method of downmixing multi-channel audio signals to target channels, the method comprising:

determining a type of block employed for encoding a corresponding audio sample with respect to each of a plurality of multi-channel frequency coefficients;

downmixing frequency coefficients to which a type of block that is most frequently used with respect to each of the target channels is applied based on a result of the determining;

converting frequency coefficients generated as a result of the downmixing and frequency coefficients that are not downmixed into signals in the time domain; and generating signals of the target channels using the signals in the time domain.

2. The method of claim 1, wherein the step of generating signals of the target channels comprises:

adjusting levels of signals generated from the frequency coefficients that are not downmixed; and downmixing the adjusted signals and signals generated from the converted frequency coefficients as a result of the downmixing.

3. The method of claim 1, wherein only the frequency coefficients of the target channels determined to have the major block type is downmixed before the conversion of the frequency coefficients into the signals in the time domain.

4. The method of claim 1, wherein the step of generating signals of the target channels comprises:

downmixing the signals generated from the frequency coefficients that are not downmixed and signals generated from the converted frequency coefficients as a result of the downmixing.

5. A downmixing apparatus for downmixing multi-channel audio signals to target channels, the downmixing apparatus comprising:

a block type determining unit that determines a type of block employed for encoding a corresponding audio sample with respect to each of multi-channel frequency coefficients;

a downmixing unit that downmixes frequency coefficients to which a type of block that is most frequently used with respect to each of the target channels is applied based on a result of the block type determining unit;

a converting unit that converts frequency coefficients generated as a result of the downmixing and frequency coefficients that are not downmixed into signals in the time domain; and a target channel signal generating unit that generates signals of the target channels by using the signals in the time domain.

6. The downmixing apparatus of claim 5, wherein the target channel signal generating unit comprises:

a level adjusting unit that adjusts levels of signals generated from the frequency coefficients that are not downmixed; and a downmixing unit that downmixes the adjusted signals and signals generated from converted frequency coefficients as a result of the downmixing.

7. The downmixing apparatus according to claim 5, wherein the plurality of block types comprises a short type and a long type.

8. The downmixing apparatus according to claim 5, wherein only the frequency coefficients of the target channels determined to have the major block type is downmixed before the conversion of the frequency coefficients into the signals in the time domain.

9. The downmixing apparatus according to claim 5, wherein the target channel signal generating unit comprises:

a downmixing unit that downmixes the signals generated from the frequency coefficients that are not downmixed and signals generated from converted frequency coefficients as a result of the downmixing.

10. A non-transitory computer-readable recording medium having recorded thereon a computer program for implementing the method of claim 1.

11. A method of downmixing multi-channel audio signals to target channels, the method comprising:

determining a type of block employed for encoding a corresponding audio sample with respect to each of a plurality of multi-channel frequency coefficients;

downmixing frequency coefficients with respect to each of the target channels to which a type of block that is determined as a major block type is applied based on a result of the determining;

converting frequency coefficients generated as a result of the downmixing and frequency coefficients that are not downmixed into signals in the time domain; and generating signals of the target channels using the signals in the time domain.

12. The method of claim 11, wherein the step of downmixing comprises, if the downmixing method is a Stereo Left/Right method and a plurality of types of blocks have been used a same number of times, a frequency coefficient to be reflected to stereo channels, determined from among the multi-channel frequency coefficients and a type of block that is not used with respect to the frequency coefficient, is determined as the major type block.

13. The method of claim 11, wherein the type of block that is most frequently used with respect to each of the target channels is determined as the major block type.

14. The method of claim 11, wherein the step of generating signals of the target channels comprises:

downmixing the signals generated from the frequency coefficients that are not downmixed and signals generated from the converted frequency coefficients as a result of the downmixing.

15. The method of claim 11, wherein only the frequency coefficients of the target channels determined to have the major block type is downmixed before the conversion of the frequency coefficients into the signals in the time domain.

16. A downmixing apparatus for downmixing multi-channel audio signals to target channels, the downmixing apparatus comprising:

a block type determining unit that determines a type of block employed for encoding a corresponding audio sample with respect to each of multi-channel frequency coefficients;

a downmixing unit that downmixes frequency coefficients with respect to each of the target channels to which a type of block that is determined as a major block type is applied based on a result of the block type determining unit;

a converting unit that converts frequency coefficients generated as a result of the downmixing and frequency coefficients that are not downmixed into signals in the time domain; and a target channel signal generating unit that generates signals of the target channels by using the signals in the time domain.

17. The downmixing apparatus of claim 16, wherein if the downmixing unit performs a Stereo Left/Right downmixing method and a plurality of types of blocks have been used a same number of times, the downmixing unit determines a frequency coefficient to be reflected to stereo channels from among the multi-channel frequency coefficients and determines a type of block that is not used with respect to the frequency coefficient as the major type block.

18. The downmixing apparatus according to claim 16, wherein the type of block that is most frequently used with respect to each of the target channels is determined as the major block type.

19. The downmixing apparatus according to claim 16, wherein only the frequency coefficients of the target channels determined to have the major block type is downmixed before the conversion of the frequency coefficients into the signals in the time domain.

20. The downmixing apparatus according to claim 16, wherein the target channel signal generating unit comprises:

a downmixing unit that downmixes the signals generated from the frequency coefficients that are not downmixed and signals generated from converted frequency coefficients as a result of the downmixing.

* * * * *